US005998800A

United States Patent [19]

Geinitz et al.

[11] Patent Number: 5,998,800

[45] Date of Patent: Dec. 7, 1999

[54] PIPE OVERPACK CONTAINER FOR TRASURANIC WASTE STORAGE AND SHIPMENT

[75] Inventors: Richard R. Geinitz, Arvada; Donald T. Thorp, Broomfield; Michael A. Rivera, Boulder, all of Colo.

[73] Assignee: The United States of America as represented by the United States Department of Energy, Washington, D.C.

[21] Appl. No.: 09/023,010

[22] Filed: Feb. 12, 1998

[51] Int. Cl.[6] ..... G21F 5/00

[52] U.S. Cl. ..... 250/506.1; 250/507.1

[58] Field of Search ..... 250/506.1, 507.1; 376/272

[56] References Cited

U.S. PATENT DOCUMENTS

| | | | |
|---|---|---|---|
| 3,935,467 | 1/1976 | Gablin | 250/507.1 |
| 3,982,134 | 9/1976 | Housholder et al. | 250/506.1 |
| 4,190,160 | 2/1980 | Andersen et al. | 250/506.1 |
| 4,197,467 | 4/1980 | Williams | 250/507.1 |
| 4,445,042 | 4/1984 | Baatz et al. | 250/506.1 |
| 4,560,069 | 12/1985 | Simaon | 250/506.1 |
| 4,845,372 | 7/1989 | Mallory et al. | 250/506.1 |
| 5,391,887 | 2/1995 | Murray | 250/506.1 |
| 5,560,511 | 10/1996 | McNerney | 250/506.1 |
| 5,564,498 | 10/1996 | Bochard | 250/506.1 |
| 5,848,112 | 12/1998 | Shimazaki et al. | 250/506.1 |

*Primary Examiner*—Bruce C. Anderson
*Attorney, Agent, or Firm*—Bradley Smith; Mark Dvorscak; William R. Moser

[57] ABSTRACT

A Pipe Overpack Container for transuranic waste storage and shipment. The system consists of a vented pipe component which is positioned in a vented, insulated 55 gallon steel drum. Both the vented pipe component and the insulated drum are capable of being secured to prevent the contents from leaving the vessel. The vented pipe component is constructed of ¼ inch stainless steel to provide radiation shielding. Thus, allowing shipment having high Americium-241 content. Several Pipe Overpack Containers are then positioned in a type B, Nuclear Regulatory Commission (NRC) approved, container. In the current embodiment, a TRUPACT-II container was employed and a maximum of fourteen Pipe Overpack Containers were placed in the TRUPACT-II. The combination received NRC approval for the shipment and storage of transuranic waste.

21 Claims, 4 Drawing Sheets

PIPE OVERPACK CONTAINER FOR TRASURANIC WASTE STORAGE AND SHIPMENT

CONTRACTUAL ORIGIN OF THE INVENTION

The United States Government has rights in this invention pursuant to Contract No. DE-AC34-95RF00825 between the U.S. Department of Energy and Kaiser Hill Company LLC.

BACKGROUND OF THE INVENTION

This invention relates an improved apparatus for the transportation and storage of high plutonium content transuranic waste. In particular, Applicants' apparatus allows for the shipment and storage of transuranic waste at a rate 8.6 times greater than is available using currently available technology. Employing a TRUPACT-II, type B external container, in conjunction with currently available interior containers only 325 Fissile Grams Equivalent(FGE) can be shipped to an approved tranuranic waste repository in a single TRUPACT-II container. Using Applicants' inner container in conjunction with the TRUPACT-II, 2800 FGE can be shipped to an approved nuclear waste storage site per TRUPACT-II container. In addition, Applicants' container provides additional radiation shielding for the handling of wastes with high Americium-241 (Am241) content.

Applicants' container was approved for use in the TRUPACT-II shipping container by the Nuclear Regulatory Commission in 1997 for the handling of wastes. The container was subsequently evaluated and approved for storage of highly dispersible TRU wastes and residues.

The initial accident testing of the TRUPACT-II shipping container showed that the lids of the drums contained in the container could come off during a hypothetical accident and allow the contents of the drum to lose spacing control from a criticality standpoint. Based on this possibility, and the appropriate worst case assumptions, a TRUPACT-II criticality limit of 325 FGE was calculated. The Pipe Component, contained in Applicants' Pipe Overpack Container was designed and tested to maintain containment of its contents during normal transport and hypothetical accident conditions. The criticality calculations crediting the Pipe Component showed that the criticality requirements were met, thus, increasing the limits of the TRUPACT-II to 2800 FGE.

The Pipe Overpack Container system, which includes the Pipe Component as its central feature, was designed, tested, and qualified as a Nuclear Regulatory Commission approved, enhanced TRUPACT-II payload container. Applicants' apparatus in conjunction with the TRUPACT-II system allows for more efficient transport and disposal of certain residues and wastes at an appropriate waste disposal sites.

The following benefits occur from the use of the Pipe Overpack Container:

- Increased criticality limits for the TRUPACT-II Type B shipping container. Up to fourteen Pipe Overpack Containers can be shipped in a TRUPACT-II. Each container may have a maximum fissile gram equivalent loading of 200 grams, for a total TRUPACT-II load of 2800 FGE. For shipments of waste packaged in payload containers other than the Pipe Overpack Container, the limit is 325 FGE per TRUPACT-II.
- The Pipe Overpack Container provides for radiation shielding for high Americium-241 content transuranic wastes.

- Use as a structurally enhanced system for the storage of highly dispersible materials containing plutonium.

A test program was developed and implemented to demonstrate the integrity of the Pipe Overpack Container under hypothetical transportation accident conditions. Normal conditions of transport were bounded by the test program. Additional testing was performed for safe interim storage.

Transportation tests of 30 ft top and side impact drops of loaded Pipe Overpack Containers, were performed. The drop tests simulated the interaction effects of other fully loaded Pipe Overpack Containers within a TRUPACT-II.

The transportation testing consisted of:

- Three top-impact drop tests were performed. In each test, two drums were strapped end-to-end as if positioned for transport within a TRUPACT-II. Top impact tests were performed for the following configurations of overpacks:
- Two 55 gallon drums containing 6 in diameter pipe components;
- Two 55 gallon drums containing 12 in diameter pipe components;
- Two 55 gallon drums: one containing a 6 inch diameter pipe component and one containing a 12 inch diameter pipe component.
- One side impact test was performed by dropping an uncertified but functional TRUPACT-II Inner Containment Vessel (ICV) with a payload assembly. The payload assembly consisted of a top layer of seven Pipe Overpack Containers containing 6 inch diameter pipe components and a bottom layer of seven Pipe Overpack Containers containing 12 inch diameter pipe components. This drop demonstrated a worst case, as damage to the Pipe Overpack Containers would be less severe within the entire TRUPACT-II package, which includes ten inches of impact-absorbing foam.

The site storage testing consisted of:

- A dynamic crush test of the Pipe Overpack Container was performed where the container was placed on an unyielding target, and a 500 kg steel plate 1 m square was dropped from 30 ft height onto the package. The test was performed with the container in an upright orientation as it is the orientation they will be in during storage, and the test was designed to simulate loading on the container if the roof of the storage building were to collapse onto the package.
- A bare Pipe Component drop test was performed. This test consisted of dropping bare inner Pipe Components onto an essentially unyielding target from a height of 10 ft. The tests were performed with the bolted closure of the pipe impacting the target first. The tests were performed to simulate a handling accident in which the pipe is dropped prior to being placed within the overpack. The test also demonstrated safety for a scenario where the interim storage of the pipes in racks without the protective overpack.
- The final test was an engulfing pool fire test. In this test four Pipe Overpack Containers were placed on an open support stand with 1 m spacing between them in a square array. The bottom of the units were 1 m above the surface of a 10 square meter pool of jet fuel floating on top of a layer of water. The fuel was ignited and allowed to burn for 30 minutes. This type of fire test generally results in a flame temperature between 1073 K and 1373 K. The test was performed to simulate a fire in a storage building. Two designs of drum filters were tested in the fire: A stainless steel housing—carbon media filter, and a polyethylene housing—carbon filter media filters.

A helium leak test was one of the methods used to determine if the Pipe Component passed or failed the tests. The Pipe Components used in the tests were fitted with leak test ports to allow connection to the leak detector. To facilitate this test, the outlet ports of the filters were sealed with vacuum putty or a clamping fixture, which allowed the gasket between the filter and the Pipe Component to be tested. After the tests, the filters were removed, and an evaluation of the filter performance was conducted by the filter manufacturer.

There was no loss of containment in any drop or crush tests. All Pipe Components had a leakage rate of less than $1\times10^{-7}$ $cm^3/s$. The filters showed no damage from the drop and crush tests. They were verified to have met flow and filtering requirements.

The engulfing pool fire test had mixed results. With one exception, all Pipe Components were found to be leak tight after the fire test. One Pipe Component was found to have a helium leak rate of approximately 24 $cm^3/s$ after the fire test where leakage was detected between the lid and the weld neck flange and between the filter and the lid. The drum which contained this unit had the stainless steel-housed filter rather than the polyethylene filter. During the fire test, this drum became sufficiently pressurized to blow off the drum lid. At this point, the Pipe Component was exposed directly to the heat from the fire, and the elastomeric O-ring and filter gasket were both destroyed. The polyethylene-housed drum filters installed in the lids of the other three drums melted and were blown out of the drum lid. This provided a pressure relief pathway sufficient enough to prevent the lids from blowing off. Although the containment provided by the drum was compromised, the Pipe Components contained therein retained their integrity and did not leak.

A series of criticality analyses modeled TRUPACT-II payload assemblies of Pipe Overpack Containers to evaluate the highest system "k-effective" value possible. The analyses constructed potential configurations of postulated accident geometries for a payload of Pipe Overpack Containers. The model evaluated a loading of 200 grams of Pu239 per Pipe Overpack Container in both dry and water-saturated forms. The following conservative assumptions were used in the analyses under normal transport conditions and hypothetical accidents:

- Elimination of the 55 gallon drums, packing material, and any cans used inside the Pipe Components as migration barriers;
- Uniform distribution of water moderator in the waste;
- Closely packed geometry of fourteen Pipe Components without the presence of any other material;
- Flooding of the TRUPACT-II with the moderation medium;
- Reflection of escaping neutrons into the system.

These assumptions are comparable to those used in the criticality analyses performed for other authorized payload containers with one exception. One key assumption used to analyze the criticality potential and to establish control limits for other payload containers was that all fissile material within the payload containers would breach the packaging to come together under hypothetical accident conditions. The Pipe Component impact testing results demonstrate that the structural integrity of the Pipe Component prevents the release of its contents under hypothetical accident conditions. Thus, the criticality analyses assume no loss of containment by the Pipe Component despite the elimination of the drum, packing material, and any layers of confinement used inside the Pipe Component.

The results of the analysis show that no simulation of TRUPACT-II payload assemblies of Pipe Overpack Containers exceeded an average k-effective value of 0.9. This demonstrates that the system was subcritical in all cases. Therefore, a TRUPACT-II shipment of fourteen Pipe Overpack Containers with 200 FGE each is safe for transportation and meets criticality requirements for transport during normal and hypothetical accident conditions.

The Pipe Overpack Container has been assessed for its radiation shielding. Effective radiation shielding depends on a continuous barrier of dense material (i.e., steel) without openings that would allow radiation "streaming" or leakage. Both Pipe Component designs provide a nominal ¼ inch of steel for shielding of 60 Kev gamma radiation from Americium (Am241). The Pipe Component has a design feature to prevent radiation streaming through the relatively low density filter media of the filter vents. Puncture protection is also provided to the filter media via the same design.

The Pipe Overpack Container must meet the TRUPACT-II Safety Analysis Report for Packaging (SARP) requirements for dose rate limits. The measured radiation dose rates of each Pipe Overpack Container must comply with the 200 millirem/hour at the container surface and 10 millirem/hour at two meters requirement. It is estimated that the worst case loading using the Pipe Overpack Container will produce no more than 10 millirem/hour combined gamma and neutron at the surface of the container.

Finite element modeling was used to support analysis of the Pipe Overpack Container to resolve storage accident scenarios where physical testing of the container could not be easily performed. Two scenarios were evaluated. One risk to the integrity of the Pipe Overpack Container during handling and storage is an accident where the Pipe Overpack Container drum is punctured by the tine of a forklift. The other accident scenario analyzed involves the collapse of the roof of a storage building.

The forklift accident scenario assumed a 4920 kg forklift traveling at 4.5 m/s pinning the Pipe Overpack Container against a rigid wall. The impacting position of the tine was chosen to maximize damage of the Pipe Component. Both the 6 and 12 inch diameter Pipe Components were capable of stopping the forklift without a total failure of the component. The pipes were bent significantly but remained relatively intact. The strain concentrations caused when the outside tip of the tine impacted the pipe were high enough to assume that localized tearing of the pipe wall would occur at this location. The design of the tine used in the analyses had a squared off end which greatly contributed to the strain concentration.

A slightly off-center impact was analyzed to determine whether it was a more severe impact than the symmetrical impact conditions. The ability of the Pipe Component to move away from the tine was effective at keeping the strains in the Pipe Component to below the failure strain limits.

The building collapse scenario evaluated the collapse of the roof structure of the storage building onto the Pipe Overpack Container. Three possible impact orientations were selected for the analysis: a flat section of roof impacting the top of the Pipe Overpack Container, a flat section of roof impacting the side of the container, and the edge of a roof section impacting the side of the container. In all of these analyses, the roof section was assumed to be rigid and traveling at constant velocity. The amount of energy absorbed by the package at its failure point was calculated which allowed the risk assessment to determine the weight of a roof section necessary to cause the package to fail.

In a real accident, it is possible that more than one container will be impacted by the collapsing roof structure.

Under these conditions, the total energy absorbed will be equal to energy absorbed by each package times the number of packages impacted by the falling roof structure. The amount of energy absorbed by a single package gives an indication of how massive a roof section can fall from a given height without causing package failure. From the analysis, a single 6 inch Pipe Overpack Container in an end impact orientation implies that this package would not fail if impacted by a 2950 kg roof section falling from 6.1 m. For a 10.2 cm thick reinforced concrete slab, this equates to a section more than 3.65 meter square. For the impact of an edge of a roof section onto the side of the 12 in. Pipe Overpack Container, the absorbed energy is equal to a 232 kg roof section falling from 6.1 m. For a 10.2 cm thick roof slab, this weight is equal to a 1.06 meter square section. The edge of a roof section falling on the side of a 12 inch Pipe Overpack Container in its most vulnerable location is the most damaging case.

The development, testing, and approval of the Pipe Overpack Container have resulted in its approval for use. Utilization of the Pipe Overpack Container results in substantial optimization of packaging transuranic wastes and their shipment to an approved disposal site. It further reduces the risks to the workers and the public.

Thus, it is an object of this invention to provide an inner container for use with a Nuclear Regulatory Commission (NRC) approved type B outer container, in the current enablement a TRUPACT-II, to transport transuranic waste.

It is a further object of this invention to provide an inner container for use with an NRC approved type B outer container for the transport of transuranic waste material where the inner container provides radiation shielding to allow for the transportation of waste material having a high Americium-241 content.

It is a further object of this invention to provide an inner container for use with an NRC approved type B outer container for the storage of transuranic waste material where the inner container provides radiation shielding.

Finally, it is an object of this invention to provide for an inner container for use with an NRC approved type B outer container for the transportation and storage of highly dispersible materials containing plutonium.

Additional advantages, objects and novel features of the invention will become apparent to those skilled in the art upon examination of the following and by practice of the invention.

SUMMARY OF THE INVENTION

To achieve the foregoing and other advantages, this invention comprises a design for an inner container, Pipe Overpack Container, to hold radioactive waste for more efficient transportation to the disposal site. The invention, also, provides for safe storage of waste awaiting transportation to the disposal site. To accomplish these functions, the Pipe Overpack Container is used in conjunction with an NRC approved type B container, the TRUPACT-II. The Pipe Overpack Container has as its core an inner capped containment vessel or pipe component. The inner containment vessel has a venting system integral to the pipe component lid. The lid is attached to the body of the pipe component or vessel after the transuranic waste is deposited into the chamber formed by the body of the pipe component and its base. The closed pipe component fits in a packing material receiptor site interior to the volume of packing material which fills a fifty-five gallon steel drum. Layers of insulating material enclose the pipe component. A vented drum lid covers the insulating material and is fastened into place with a locking ring.

BRIEF DESCRIPTION OF THE DRAWINGS

The present invention is illustrated in the accompanying drawings where.

DETAILED DESCRIPTION OF THE INVENTION

The subject invention is an apparatus for use with an appropriate Nuclear Regulatory Agency approved type B containment system, such as the TRUPACT-II, for more efficient transport to and storage of radioactive waste at a disposal site.

Figure 1:
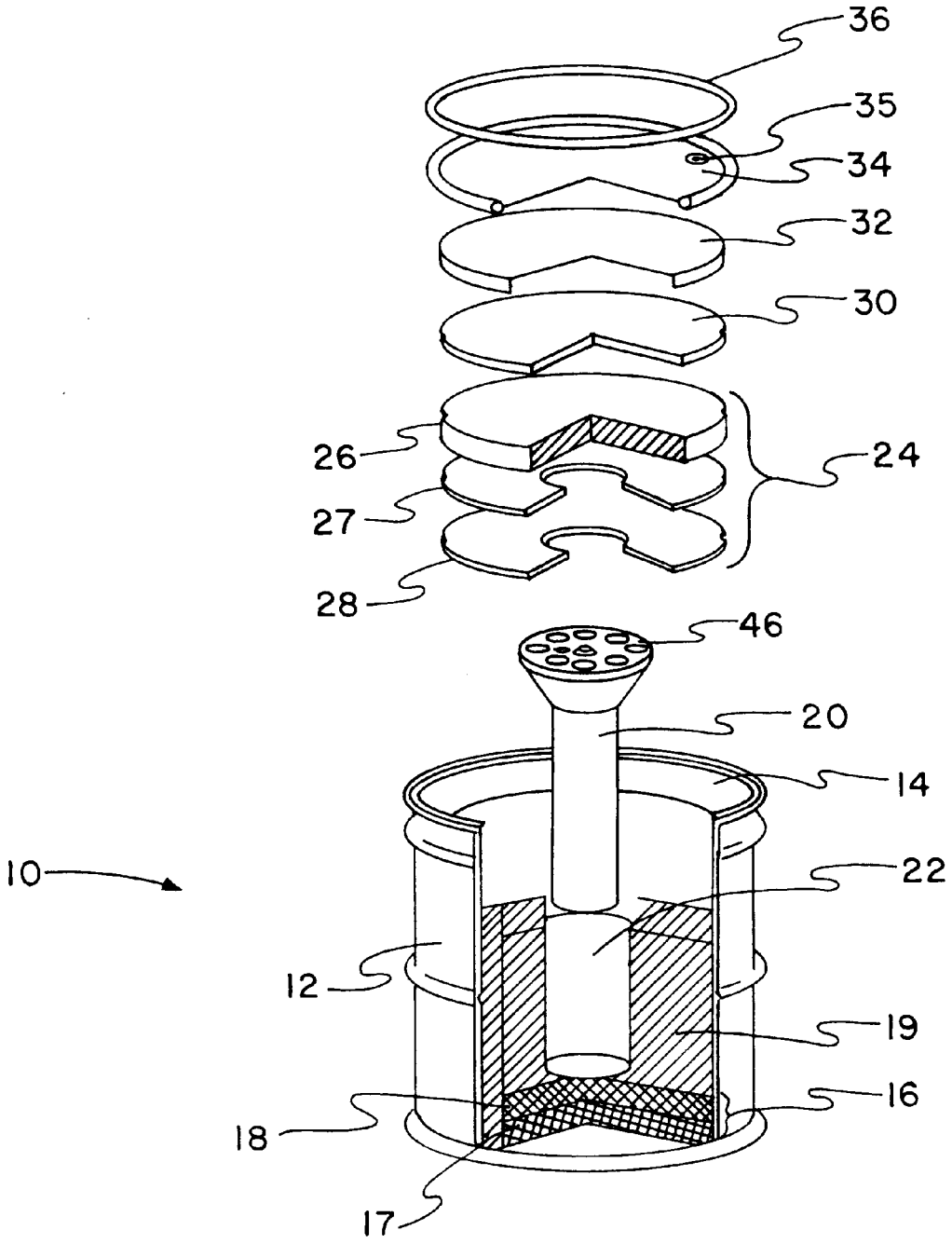
FIG. 1 is an exploded drawing of the Pipe Overpack Container system.

The Pipe Overpack Container system 10 is illustrated in FIG. 1. The Pipe Component 20 is placed within a standard Department of Transportation (DOT)-17C Type A 210 liter (55 gallon) steel drum 12. The drum 12 is lined with a standard rigid plastic drum liner 14 which lines the sides and base of the drum 12. The base of the liner 14 is fitted with a two part bonded assembly 16 comprised of a layer of plywood bonded to a layer of fiberboard, in the current enablement, Celotex® fiberboard is used. The fiberboard layer 17 contacts the base of the liner 14 followed by the plywood 18. The bonded assembly 16 is sized to fit inside the liner 14 and to rest on the base of the liner 14. The drum 12 is filled with fiberboard packing 19 which is sized to fit inside the drum liner 14. The fiberboard packing 19 is formed from a series of fiberboard sheets cut to fit the inner diameter of the drum liner 14. The fiberboard packing 19 rests on the bonded assembly 16 and is configured to accept the pipe component 20. The pipe component 20 fits into a cylindrical cavity 22 formed in the fiberboard packing 19 so that the pipe component 20 is in close proximity to the fiberboard packing 19. The base of the pipe component rests on the bonded assembly 16. A three part bonded assembly 24 fits over the top and laterally stabilizes the pipe component 20. The three part assembly 24 consists of a solid piece of fiberboard 26 sized to fit the cross sectional dimensions of the drum liner 14, a layer of plywood 27 cut to the same size as the solid piece of fiberboard 26 and bonded to the fiberboard. A circle is cut from the center of the board 27 to accommodate the cap 46 on the pipe component 20. In an optional embodiment, the plywood 27 may be replace by a sheet of similarly formed fiberboard. Finally, a piece of fiberboard 28 is configured to match the cross sectional area of the plywood 27, and is bonded to the plywood 27. This piece of fiberboard 28 also has a center hole to accommodate the cap 46 of the pipe component 20. The bonded assembly 24 rests on the fiberboard packing 19 with the top of the pipe component 20 fitting into the circular evacuation cut into layers 27 and 28. A fiberboard spacer 30 is sized to the inner diameter of the drum liner and fits on top of the three part bonded assembly 24. The drum liner lid 32 engages the drum liner and is above the spacer 30. The fiberboard packing serves to protect the pipe component 20 from damage caused by external forces or conditions. The fiberboard, also, serves as thermal insulation. The drum lid 34 is fitted with a polyethylene-housed carbon composite filter 35 which penetrates the drum lid 34. The drum lid 34 covers the open end of the drum 12 and is secured to the drum 12 with a standard drum lid locking ring 36.

Figure 2:
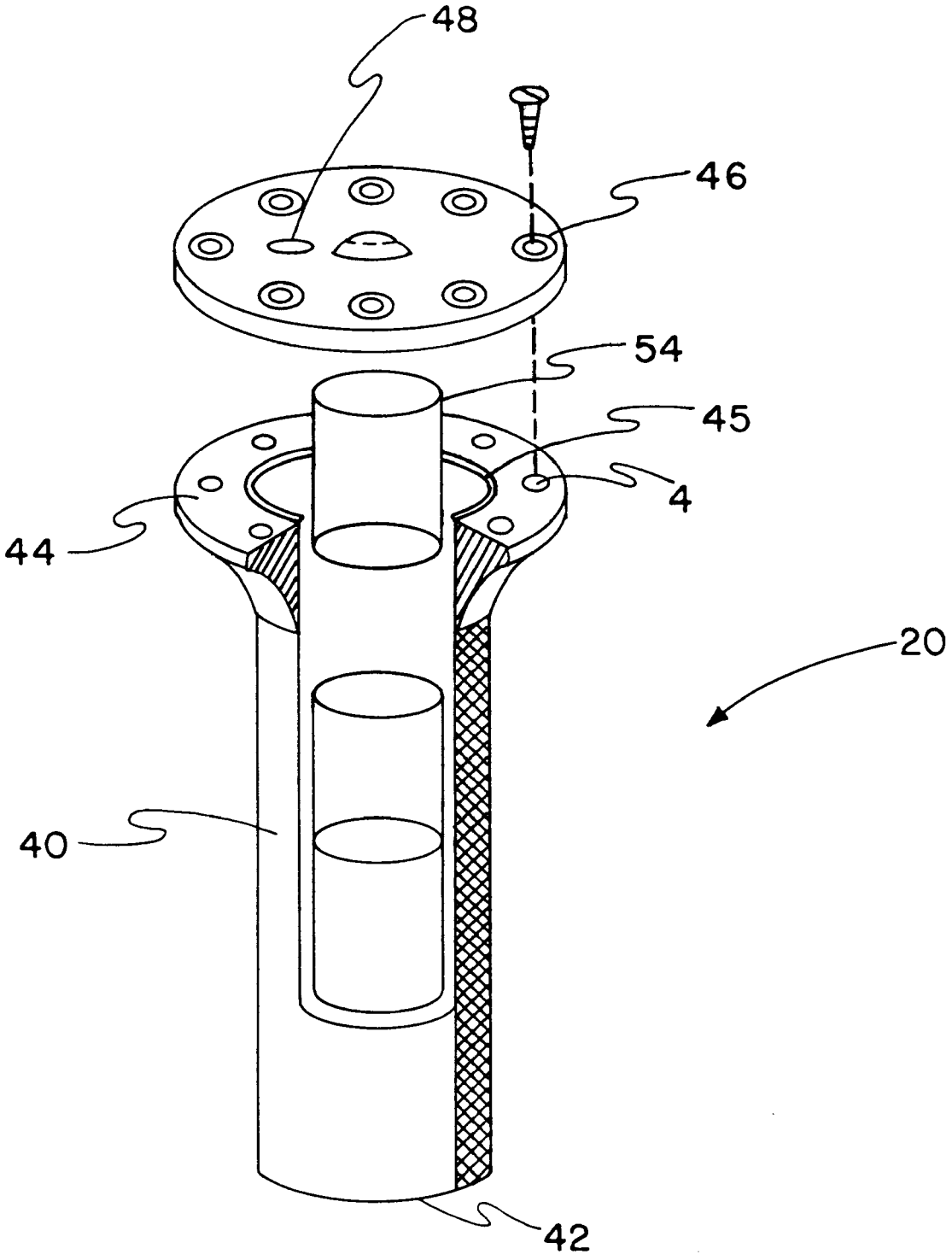
FIG. 2 is an exploded drawing of the pipe component.
Figure 3:
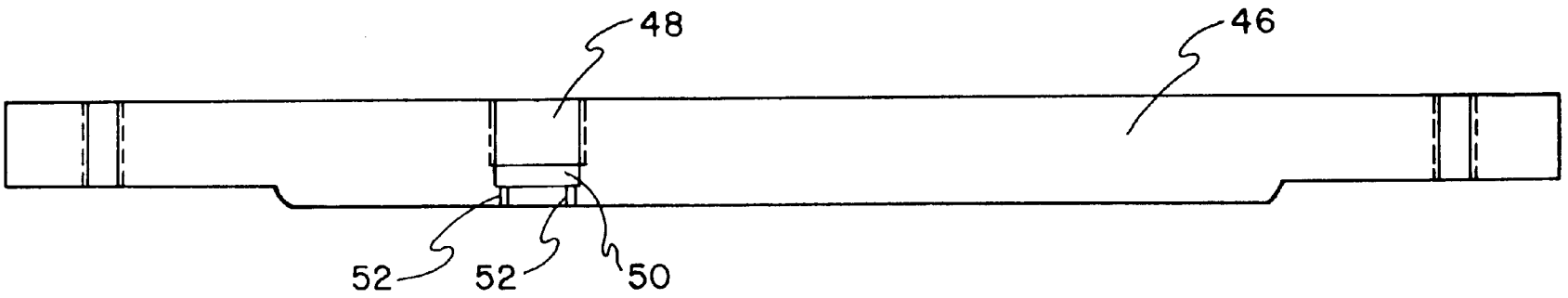
FIG. 3 is an illustration of a cut section of the lid of the pipe component.
Figure 4:
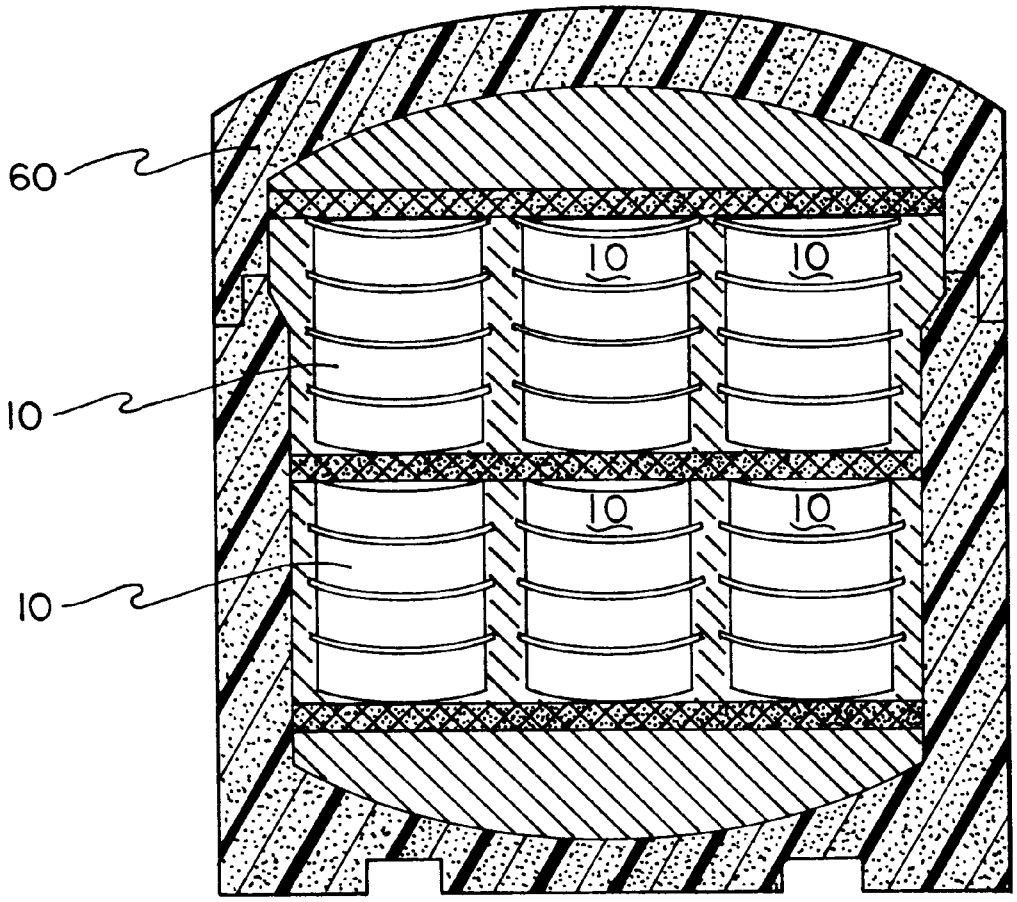
FIG. 4 shows the pipe overpack container system in conjunction with a TRUPACT-II system.

The pipe component 20 is illustrated in FIG. 2. The body of the pipe 40 is designed for two sizes: 15.2 cm (6 in) and 30.5 cm (12 in) in diameter, each with a nominal length of 63.5 cm (25 ½ in). The usable volumes are approximately 12 liter and 48 liter, respectively. The 6 in diameter version is constructed of Schedule 40 304L stainless steel. The 12 in diameter model is fabricated from Schedule 20 stock. The nominal wall thickness in both cases is ¼ in. The bottom end cap 42 closes the bottom opening of the pipe body 40 and has a minimum thickness of ¼ in. The bottom end cap 42 is welded to the pipe body 40 effectively forming a sealed base. The top end of the pipe body 40 is fitted with a 150 lb. weld neck flange 44 for the 6 in diameter pipe body and a non-standard, lighter weight weld neck flange 44 for the 12 in diameter pipe body. The flange 44 is welded into position. The flange 44 is machined along its inner diameter lip to incorporate a ⅛ inch cross-section diameter ethylene propylene O-ring gasket 45 ensuring containment of particulate material which is stored inside the pipe body. A series of eight tapped holes 43 encircle the lip of the neck flange. A 1 in thick steel lid 46 covers the neck flange 44 and a series of eight holes are machined in to the lid 46 in such a manner that when the lid is positioned over the neck flange the machined holes of the lid are in alignment with the tapped holes of the neck flange 44 so as to allow the lid to be bolted to the neck flange 44. Incorporated into the lid 46 is a sintered stainless steel filter 48. As is shown in FIG. 3, the filter 48 does not penetrated the lid in either the 6 or 12 in. diameter pipe, but rather screws in leaving a gap between the base of the filter 48 and the base of the accommodation hole 50. The remaining steel at the base of the hole provides shielding for the filter 48. Four 3/32 inch holes 52 are drilled equidistant around the perimeter of the base of the accommodation hole and through the remaining steel lid thickness to provide continuous venting capability to the interior or the pipe component 20 and access of any gasses which might accumulate in the inner chamber of the pipe component to the stainless steel filter 48. The holes 52 are offset from the filter media, avoiding a line of sight radiation streaming path. As is depicted in FIG. 2 the interior of the pipe component 20 is sized to accommodate contamination barrier cans 54. The interior barrier contamination cans can be used to hold and transport the waste in the pipe component 20; however, the use of the barrier cans 54 is not necessary. In operation, the cans are inserted into the interior of either a pipe component having a 6 or 12 inch diameter. After the waste is placed in the pipe component, the lid is bolted into position and the pipe component is fitted into the receptacle in the drum 12. The various spacers are put into place and the drum lid attached and secured. The containers 10 are then loaded into a TRUPACT-II type B container 60, FIG. 4. Fourteen pipe overpack containers 10 are fitted into one TRUPACT-II container 60 for shipment, FIG. 4.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. It is intended that the scope of the invention be defined by the claims appended hereto.

The embodiment of this invention in which an exclusive property or privilege is claimed is defined as follows:

1. A container for the transportation and storage of radioactive waste comprising:

An outer container having continuous elongated side walls permanently attached to an outer container base and having a removable vented outer container lid capable of being securely attached to an upper rim of said side walls where said side walls have an inner surface and where said container base has an inner surface;

a means for attaching said vented outer container lid to said outer container;

a liner which fits adjacent to said inner side wall surface and said inner base of said outer container and where said liner has a liner lid which fits over an upper lip of said liner;

a vented inner containment vessel having a continuous elongated outer wall attached to a solid base to form an interior chamber where said interior chamber is capable of receiving radioactive waste and where said outer wall is formed to receive a vented containment vessel lid and where said containment vessel lid is capable of being securely attached to said outer wall of said containment vessel;

a volume of insulation material shaped to fit inside of said outer container and shaped to receive said vented inner containment vessel where an outside surface of said material is in close proximity to an inner surface of said liner;

a base spacer positioned to separate said liner base from said inner vented containment vessel and to support said inner containment vessel and where said volume of insulation material rests on said base spacer;

a plurality of layers material spacers sized to fit in close proximity to said inner surface of said liner where said spacers cover said containment vessel and where said plurality of said spacers are supported by said volume of insulation material.

2. The apparatus of claim 1 where the outer wall of said inner containment vessel is a 6 inch diameter steel pipe having a thickness of ¼ inch.

3. The apparatus of claim 2 where the steel is Schedule 40 304L stainless steel.

4. The apparatus of claim 1 where the outer wall of the containment vessel is a 12 inch diameter steel pipe having a thickness of ¼ inch.

5. The apparatus of claim 4 where said pipe is fabricated from Schedule 20, 304 L stainless steel.

6. The apparatus of claim 1 where said base spacer is comprised of two layers: a first layer of fiberboard and a second layer of plywood where said fiberboard layer is positioned next to said liner and where said layers are bonded together.

7. The apparatus of claim 1 where said volume of insulation is formed from a series of layers of fiberboard.

8. The apparatus of claim 1 where said plurality of spacers is formed from a bonded assembly and a fiberboard spacer where said bonded assembly consists of three layers: a first fiberboard layer followed by a second plywood layer and then a third fiberboard layer and where all three layers are bonded together.

9. The apparatus of claim 8 wherein said first and said second layer are sized to receive said containment vessel lid when said bonded assembly is fitted over said containment vessel.

10. The apparatus of claim 1 where said plurality of spacers is formed from a bonded assembly and a fiberboard spacer where said bonded assembly consists of three fiberboard layers bonded together.

11. The apparatus of claim 10 where two fiberboard layers are sized to receive said containment vessel lid when said bonded assembly is fitted over said containment vessel.

12. The apparatus of claim 1 wherein said removable outer vented container lid has a polyethylene-housed carbon composite filter.

13. The apparatus of claim 1 wherein said vented containment vessel lid has a machined cavity in said lid which does not penetrate said lid but rather, leaves a cavity base separating an inner side of said lid from said cavity base and where an upper portion of said cavity is tapped to receive a filter.

14. The apparatus of claim 13 wherein said filter is capable of having a 99.9% collection efficiency.

15. The apparatus of claim 13 where said filter is a sintered stainless steel filter having an efficiency greater than 99.9%.

16. The apparatus of claim 15 wherein a plurality of small holes penetrate said cavity base and where said holes are positioned around a perimeter of said cavity.

17. The apparatus of claim 1 where an interior edge of said lip of said containment vessel is machined to form a o-ring retaining surface and where an o-ring is positioned on said o-ring retaining surface.

18. The apparatus of claim 1 wherein said interior chamber of said vented inner containment vessel is capable of receiving one or more contamination barrier cans.

19. The apparatus of claim 18 wherein one or more contamination barrier cans are placed in said interior chamber of said vented inner containment vessel.

20. A method of transporting and storing large amounts of transuranic waste comprising the steps of:

placing transuranic waste in a vented containment vessel;

securing the vented containment vessel to prevent leaks;

placing said containment vessel in a vented, insulated outer container;

securing a lid on said outer container;

placing a plurality of said secured outer containers in a Nuclear Regulatory Commission approved type B shipping and storage container.

21. The method of claim 20 wherein one or more contamination barrier cans containing tranuranic waste are placed in said vented containment vessel.

* * * * *